United States Patent [19]

Frahm

[11] 4,071,002

[45] Jan. 31, 1978

[54] THROTTLE AND IGNITION ADVANCE LINKAGE FOR AN INTERNAL COMBUSTION ENGINE

[75] Inventor: James H. Frahm, Oshkosh, Wis.

[73] Assignee: Brunswick Corporation, Skokie, Ill.

[21] Appl. No.: 668,137

[22] Filed: Mar. 18, 1976

Related U.S. Application Data

[63] Continuation of Ser. No. 501,656, Aug. 29, 1974, abandoned.

[51] Int. Cl.[2] ..... F02D 37/00

[52] U.S. Cl. ..... 123/99; 123/97 R; 123/98

[58] Field of Search ..... 123/97 R, 98, 99, 117 R

[56] References Cited

U.S. PATENT DOCUMENTS

| | | | |
|---|---|---|---|
| 1,541,052 | 6/1925 | Hunt | 123/99 |
| 1,761,538 | 6/1930 | Schwager | 123/99 |
| 1,766,867 | 6/1930 | Woolson | 123/99 |
| 2,094,860 | 10/1937 | Timian et al. | 123/117 R |
| 2,095,829 | 6/1936 | Boyce | 123/117 R |
| 2,644,419 | 7/1953 | Heidner et al. | 123/98 |
| 2,890,689 | 6/1959 | Alexander | 123/99 |
| 2,906,251 | 9/1959 | Soder | 123/117 R |
| 3,373,725 | 3/1968 | Arpaia | 123/97 R |
| 3,769,946 | 11/1973 | Elingsen | 123/99 |

*Primary Examiner*—Charles J. Myhre
*Assistant Examiner*—David D. Reynolds
*Attorney, Agent, or Firm*—Andrus, Sceales, Starke & Sawall

[57] ABSTRACT

The carburetor throttle valve of an internal combustion engine is set in timed relation to a timing control coil by a T-shaped throttle control lever coupled to an external throttle operator and a timing control lever resiliently coupled to the throttle control lever. The two control levers are pivotally mounted on a common pivot pin secured to the engine block. The T-shaped throttle lever is pivotally mounted at the center of the cross-bar with a pair of throttle control cables secured to the opposite ends and to an external throttle control. The stem of the lever projects outwardly toward the carburetor valve input element. A cam member includes a slotted and clamp screw connection to one side of the stem to permit adjustment of the cam member along the length of the stem. A guide wal is coupled to the other side of the stem by a T-shaped stem and groove. The cam member has a first flat cam surface spaced from the valve pin at idle and an angular oriented second surface to provide an amplified throttle movement after a timing advance limit is reached. The timing lever extends across the cross-bar of the throttle lever with a hook end extended outwardly in laterally spaced relation to the stem. A coil spring connects the hook end to the stem portion. The opposite end of the timing lever is adjustably secured to the timing rod for positioning a firing coil of a capacitor discharge ignition system. A stop screw on the timing lever limits the advance firing position of the coil. The initial rotation of the throttle control lever rotates the timing lever means to TDC and the throttle lever to just engage the valve input. Rotation of the throttle lever for a relatively small angle then simultaneously rapidly advances the timing and slowly opens the throttle after which the timing lever engages the stop means and the throttle is advanced with fixed timing.

19 Claims, 6 Drawing Figures

THROTTLE AND IGNITION ADVANCE LINKAGE FOR AN INTERNAL COMBUSTION ENGINE

This is a continuation application of application Ser. No. 501,656, filed Aug. 29, 1974, now abandoned.

BACKGROUND OF THE INVENTION

The present invention relates to a throttle control apparatus for an internal combustion engine and particularly to such a control apparatus for outboard motors and the like.

Outboard motors generally include a powerhead secured to the upper end of a driveshaft housing which is provided with a swivel bracket mounting means for attaching of the outboard motor to the transom of a boat. A dependent propeller unit is secured to the lower end of the driveshaft housing and coupled by a drive shaft which extends upwardly through the driveshaft housing to an internal combustion engine mounted within the powerhead. The internal combustion engine is generally a conventional reciprocating piston type having one or more cylinders each of which includes a spark plug for firing of the fuel mixture at an appropriate time with respect to the top dead center (TDC) position of the piston. The fuel mixture supplied to the engine is further controlled by a throttle control means for varying the speed of the engine. The throttle control apparatus may be remotely controlled or in lower horsepower outboards may be controlled through a tiller handle secured to the outboard for pivoted securing of the outboard. The tiller is formed conventionally with a twist grip mechanically coupled to the throttle control. For optimum operation, the firing time of the engine varies slightly as the engine speed is increased. Generally, the timing desired includes a slight retarded firing at idle speed such that the spark plug is fired slightly after the piston reaches TDC. When the engine is accelerated, the control preferably advances the firing to TDC before the throttle control is actuated to increase the fuel supply to the engine. As the engine speed is further increased, the firing timing is advanced before TDC and preferably with the advance being rapidly established for a relatively slight throttle advance; after which the timing is held constant for the remainder throttle range, and for a greater share of the throttle range. Various interconnecting linkages have been suggested for controlling the timing advance in relationship to the actuation of throttle butterfly valve of the engine carburetor. For example, the copending application of Beck et al which is entitled "Breakerless and Distributorless Multiple Cylinder Ignition System" which was filed on July 18, 1973 with Serial No. 380,384 and which is assigned to the same assignee as the present application, discloses a trigger coil arrangement for controlling the firing of the spark plugs. The trigger coil is rotatably mounted about the crankshaft and coupled through a cam arrangement to the throttle lever to vary the position of the coil about the axis of the crankshaft and thereby provide timing control. In such systems, adjustable linkage systems are employed to permit adjustment for normal manufacturing tolerances and the like. Further, the linkage system should provide a relatively simple mechanical system which will have a long operating life under the relatively severe vibrational environment encountered in outboard motors and the like. In small outboards the available space is quite restricted and a small, compact linkage is desirable.

SUMMARY OF THE PRESENT INVENTION

The present invention is particularly directed to a compact and reliable mechanical linkage for interconnection to an engine throttle control with interconnected lever means to provide for timed sequential operation of the timing means and the throttle means. Generally, in accordance with the present invention, a pair of pivotally mounted lever means are provided including a throttle control lever means coupled to an external throttle operator and a timing control lever means resiliently coupled to the throttle control lever means. A throttle cam member is adjustably secured to the throttle control lever means. The adjustment means is set to vary the movement of the throttle control lever means before engagement with the throttle control means such as a carburetor valve means. The timing control lever means is coupled to the throttle control lever means by a resilient means such as a spring to cause the timing control lever means to follow the movement of the throttle control lever means. A stop means limits the movement of the timing control lever means with the spring means allowing the continued rotation of the throttle control lever means. The initial rotation of the throttle control lever means angularly rotates the timing lever means to advance the timing to TDC. The rotation also moves the throttle lever means just to engage the throttle control means. Further, rotation of the lever means simultaneously advances the timing and opens the throttle. This additional movement covers a relatively small angular orientation, after which the timing lever means engages the stop means.

More particularly in a preferred and novel construction of the present invention, a throttle control lever is generally a T-shaped member pivotally mounted at the center of the cross-bar or at the common junction with the stem. A pair of throttle control cables or the like are secured to the opposite ends of the cross-bar and secured at the outer end to an external throttle control, such as a rotatable drum to provide for selective pulling on the opposite ends of the throttle lever to thereby pivot the lever about the pivot pin. A cam member includes a slotted connection to the stem to permit adjustment of the cam member along the length of the stem and with a clamp means extending through one side of the cam member into the stem portion to thereby adjustably lock the cam member to the stem. The cam member includes a cam surface adapted to move into engagement with a throttle control pin means which in turn is secured to the butterfly valve of a carburetor or the like. The timing lever is pivotally secured to the common pin with a hook end extended outwardly in laterally spaced relation to the stem. A coil spring interconnects the hook end to the stem portion such that throttle opening rotation of the throttle lever results in a pulling on the spring to pivot the timing lever. The opposite end of the timing lever projects laterally in the opposite direction across the throttle control lever. A timing rod is adjustably secured to the outer end of the timing lever and extends outwardly into pivotally coupled relation to a timing means such as a rotatable support for a firing control coil. A stop screw is threaded through the timing control lever with the end thereof adjustably spaced with respect to a fixed stop member provided on the engine block or the like. The cam member may be accurately adjusted to just affect touching engagement with the throttle pin means as the timing coil is positioned at TDC and adjustable connection of the timing rod and lever permits accurate adjustment of the coil with relationship to the setting of the cam member. Further, the cam configuration and linkage establishes an expanded or amplified rotation of the timing coil with relatively small angular movement of the throttle lever.

The present invention has been found to provide a relatively simple, reliable and long-life throtthe for outboard motors and the like and particularly adapted for the lower horsepower models employing a tiller handle control.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings.

DESCRIPTION OF THE ILLUSTRATED EMBODIMENT

Figure 1:
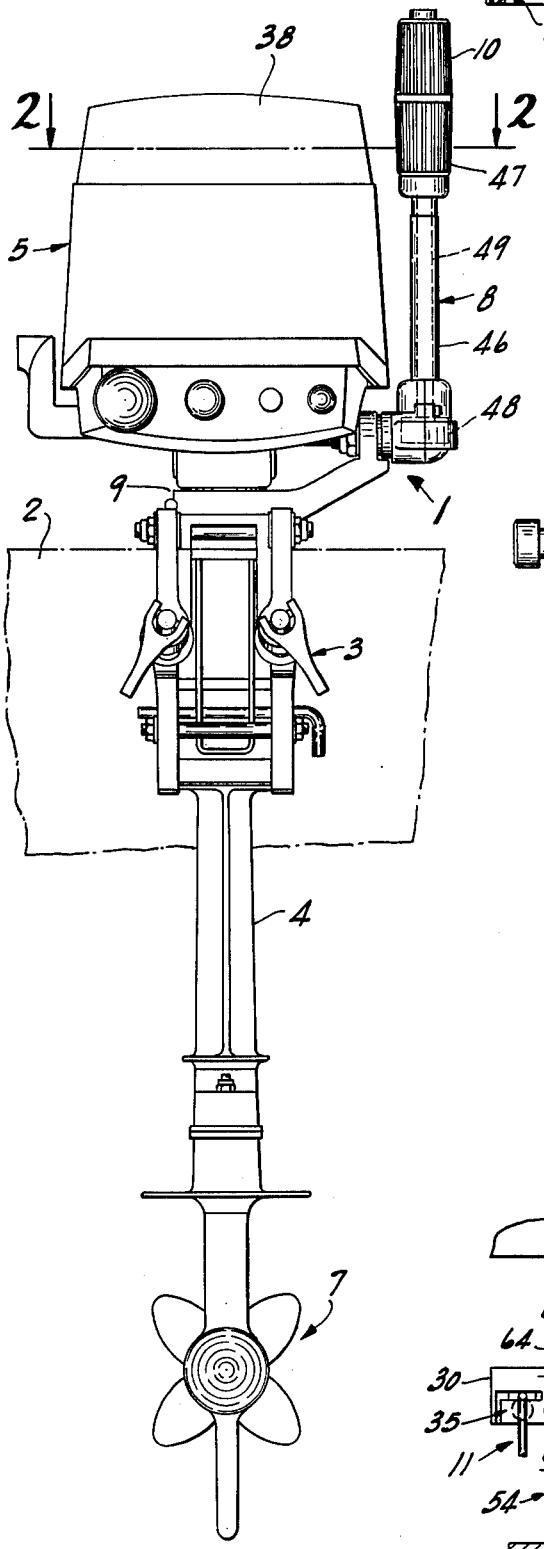
FIG. 1 is a front elevational view of an outboard motor constructed in accordance with the teaching of the present invention.
Figure 5:
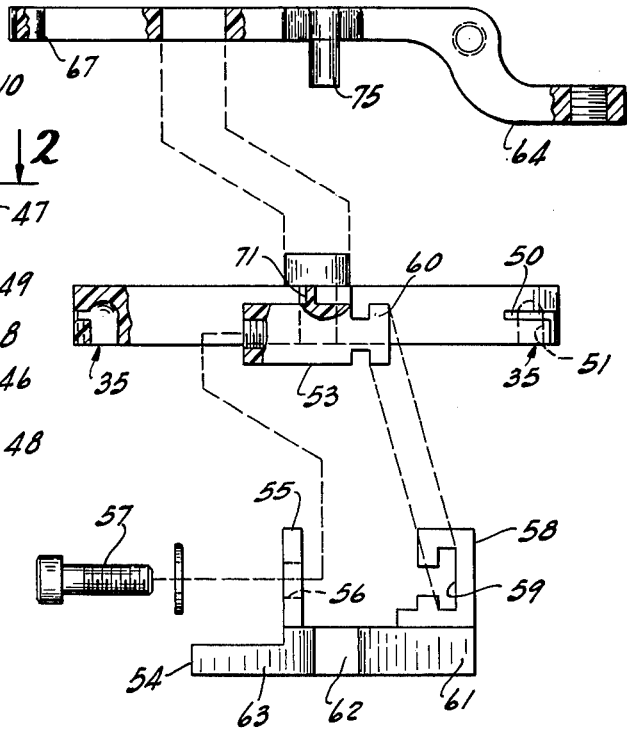
FIG. 5 is an exploded view more clearly illustrating the individual components of the linkage construction.
Figure 6:
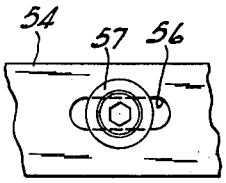
FIG. 6 is a sectional view through a portion of linkage to illustrate a throttle cam adjustment means.
Figure 2:
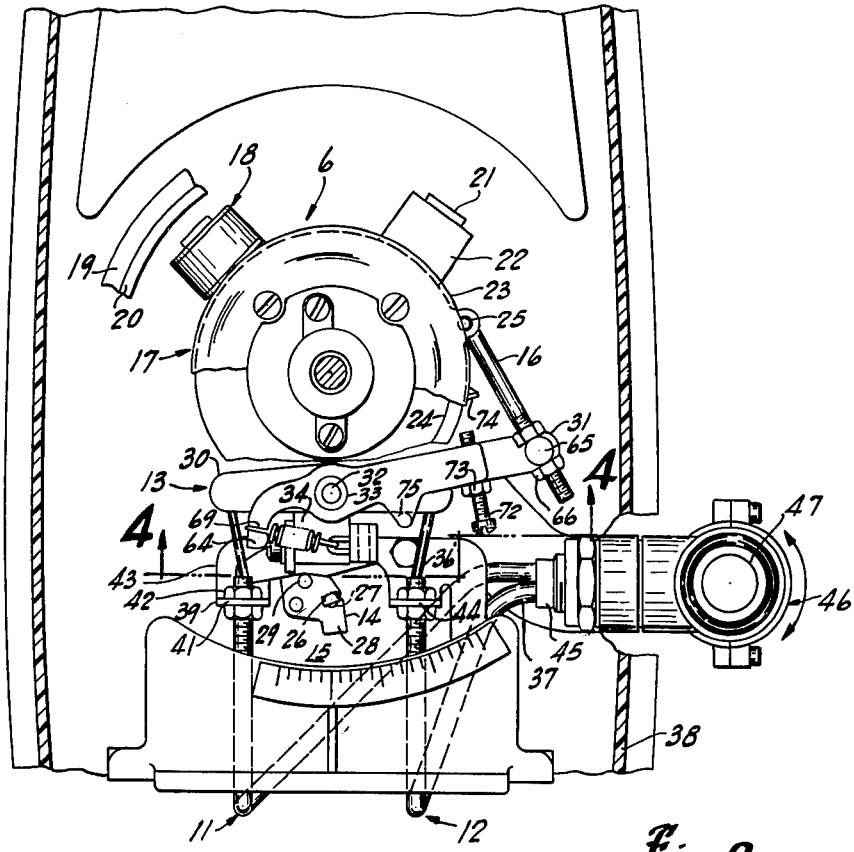
FIG. 2 is a top view of the motor with parts broken away to illustrate the present invention and with a portion of the tiller handle illustrating a throttle control.

Referring to the drawings, and particularly to FIG. 1, an outboard motor 1 is shown secured to the transom 2 of a boat by a suitable swivel bracket assembly 3. The outboard motor unit in particular includes a driveshaft housing 4 which is pivotally mounted to the swivel bracket assembly 3 in any suitable manner. A powerhead 5 is secured to the upper end of the housing 4 and encloses an internal combustion engine 6 which is coupled in accordance with a conventional construction to a lower dependent propeller unit 7 secured to the lower end of the driveshaft housing 4. A hand tiller 8 is connected to a coupling member 9 encircling the drive shaft housing 4 immediately beneath the powerhead 5 to effect rotation of the drive shaft housing 4 and the propeller unit 7 for steering of the boat. A particularly satisfactory vibrating isolating coupling is shown in the co-pending application of James A. Meyer entitled "STEERING APPARATUS FOR SMALL OUTBOARD MOTORS" which was filed on even date herewith and assigned to the common assignee herewith. The tiller is preferably constructed as shown in co-pending application of James A. Meyer entitled "STEERING APPARATUS FOR SMALL OUTBOARD MOTORS" and which was filed on even date herewith and assigned to the common assignee herewith. Generally, tiller 8 includes an outer twist handle 10 for selectively and oppositely rotating a pair of throttle control cables 11 and 12 which are secured to a throttle and timing linkage assembly 13 which particularly forms the subject matter of the present invention. Generally, the linkage assembly 13 is adapted to provide a sequential timed operation of a throttle control element 14 coupled to the carburetor 15 of the engine 6 and a spark advance arm 16 which is coupled to timing control means to provide an adjustable firing of the engine 6 to the operation of the twist handle 10. In the illustrated embodiment of the invention, the ignition system is assumed to be a suitable capacitor discharge ignition system with an alternator unit 17 secured to the upper end of the engine 6. Referring to FIG. 2, a stator coil unit 18 is secured to the engine 6 within an inverted cup-shaped flywheel 19. A permanent magnet rotor 20 is secured within the flange of the flywheel 19 and rotates with the engine. The stator coil unit is connected to provide charging of a capacitor. A trigger coil 21 is also mounted within the flywheel 19 and coupled to the magnetic rotor 20 to provide triggering signals between the periods that the magnetic rotor is coupled to the charging stator coil unit 18 to provide for timed firing and discharge of the capacitor. The trigger coil 21 is secured within a housing 22 which in turn is secured to a trigger coil support ring 23. The ring 23 is rotatably mounted to the upper end of the engine block assembly as at 24.

The spark advance arm 16 is shown as a rod pivotally pinned to an outwardly projecting lug or projection 25 on the housing ring 23. The positioning of the rod 16 affects corresponding angular orientation of the trigger coil 21 with respect to the engine crankshaft and thereby determines the precise firing point of the ignition system with respect to the position of the engine crankshaft. The position of the engine crankshaft, of course, in accordance with conventional construction is directly related to the position of the piston and permits a method of controlling the firing with respect to the top dead center position of the piston.

The throttle control unit 14 is similarly a generally conventional element including a plate-like member secured to the pivot pin 26 of the throttle butterfly valve, not shown, of the carburetor 15. A small spring 27 continuously biases the plate-like member 26 to minimum throttle position engaging a throttle stop 28. A coupling pin means 29 projects upwardly and is coupled to the unique linkage assembly 13 to provide interrelated and sequential operation of the throttle unit 14 and the spark advance arm 16.

Because the present invention is particularly directed to the linkage assembly 13, no further description is given of the carburetor or ignition system other than as necessary to clearly and fully describe the operation of the present invention.

Figure 4:
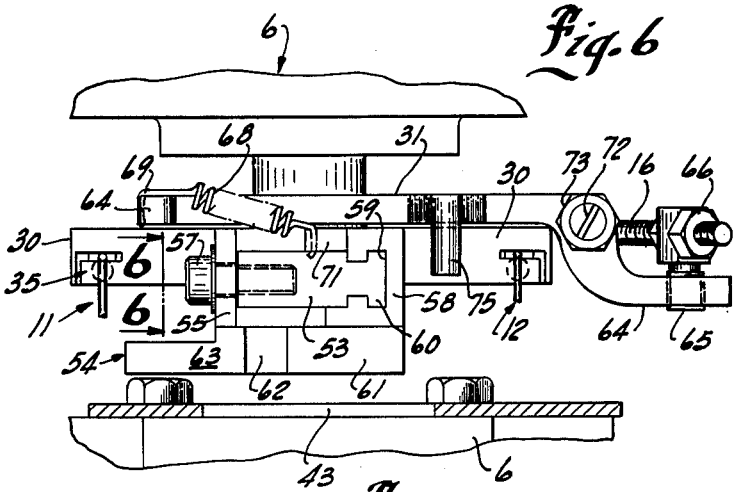
FIG. 4 is an enlarged front elevational view of the outboard motor unit shown in FIG. 1 with parts broken away and sectioned to more clearly illustrate the details of the construction of the present invention.
Figure 3:
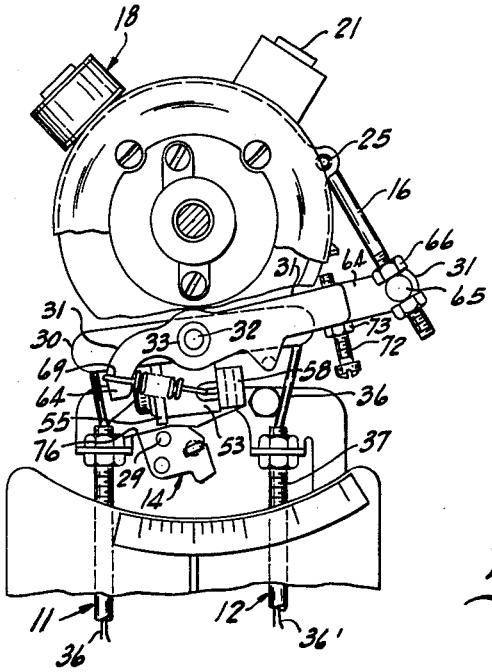
FIG. 3 is a fragmentary view of FIG. 2 illustrating a throttle idle position of the structure shown in FIG. 2.

Referring particularly to FIGS. 2–4, the illustrated embodiment of the linkage assembly 13 generally includes a throttle lever 30 and an advance or timing lever 31 pivotally mounted on a common pivot pin 32 which is secured to the front of the engine block and thus adjacent to and above the carburetor 15. The levers 30 and 31 are generally plate-like elements formed of a suitable low friction material such as a nylon or the like. The levers 30 and 31 may be mounted directly in stacked relationship on the common pivot pin 32 and secured in place by a small snap ring 33 or the like. The low friction material permits the independent movement of the levers 30 and 31 on the pivot pin 32.

More particularly, the throttle lever 30 is generally a T-shaped element having the plate-like cross-piece or bar pivotally mounted to the pin 32 at the center or at the junction thereof with a stem 34 which projects forwardly toward the carburetor 15. The opposite ends of the lever 30 terminate in similar end connection or coupling 35 to the respective cable units 11 and 12.

The cable units are of a generally conventional push-pull construction and cable unit 11 is described. A cable 36 is slidably disposed within a low friction sheath 37. The end of the cable sheath 37 within the motor cowl 38 is threaded and clamped within a recess 39 in a clamping plate 41 by a pair of clamp nuts 42 on the opposite side of the plate. The plate 41 forms one side of a U-shaped bracket member having a mounting base 43 aligned with the one end of lever 30. A similar plate 44 is in alignment with the opposite ends of the lever 30 and similarly couples cable 12 to the opposite end of lever 30. Mounting base 43 is secured to the engine block or to a carburetor attachment plate provided on the engine block.

The cable units 11 and 12 extend downwardly and through the inner cowl and outwardly through a cowl opening, which is provided. A suitable bulk insulator 45 encloses the cables and suitable control power leads and the like.

In the illustrated embodiment of the invention, the outer ends of the cables are secured within the hub of a pivotal tiller handle 46 and have an outer twist grip 47, as more fully disclosed in the previously identified co-pending application entitled "STEERING APPARATUS FOR SMALL OUTBOARD MOTORS". Generally, cables 36 are reversely wrapped about a drum 48 having a pair of guide grooves for respectively receiving the opposite cables. The cables 36 are secured to the drum which is secured to the grip 47 by shaft 49. Rotation of the twist grip 47 and the interconnected shaft results in a corresponding rotation of the drum, resulting in the winding and unwinding of the cables 11 and 12 within the grooves and thereby providing a corresponding opposite movement of the cables for pulling on the opposite ends of the lever 30.

The individual cable 36 projects from the cable sheath and is clamped to the outer end of the lever 30 by the end coupling 35. In the illustrated embodiment of the invention, the outer end of the lever 30 is provided with a laterally extending slot 50 with the underside of the lever recessed to define a latching recess 51. The end of the cable 36 is provided with a latch ball 52 which is located within the recess and couples the cable to the lever.

By similarly interconnecting the cables 36 and 36' of units 11 and 12 to the opposite ends of the lever 30, the lever can be rotated by pulling on either one of the cables. Thus as viewed in FIG. 2, rotation or pulling on right cable 36' results in a counter-clockwise rotation of the lever 30, while pulling on the opposite cable 36 results in an opposite or counter-clockwise rotation of the lever 30.

The T-shaped lever 30 includes the stem 53 which projects outwardly from the common pivot pin 32 toward the carburetor 15 to define the T-shaped configuration. A throttle cam member 54 extends beneath stem 53 and is adjustably secured to the stem 53 of the lever 30 by a generally U-shaped coupling.

A planar slotted wall 55 projects upwardly from the cam member 54 adjacent to the side wall of the stem 53 of lever 30. The wall 55 is provided with a slot 56 extended in the direction of stem 53. A clamping screw 57 passes through the slot 56 and threads into the stem 53 to releasably lock the cam member 54 to the stem 53. A guide wall 58 projects inwardly from the cam member 54 along the opposite side of the stem 53 and is provided with a generally T-shaped groove 59 adjacent the face of the stem. A T-shaped tongue 60 integrally formed with the stem 53 mates with the groove 59 to provide guided movement of the cam member 54 on the stem, with the particular position fixed by the tightening of the clamping screw 57.

The cam plate 54 is thus located immediately beneath the stem 53 and is adjustable inwardly and outwardly on the stem 53. The outer edge of the cam plate 54 defines a cam face 61 which is adapted to move into engagement with the cam pin 29.

The positioning of the cam member 53 determines the pivotal movement of the lever 30 required to establish engagement with the cam pin for initial timing advance without opening of the throttle. Further, the cam edge or face 61 is formed with a relatively flat portion 62 aligned with initial engagement to the cam pin such that the initial rotation after engagement slowly opens the throttle. The cam edge 61 extended from the flat surface is angularly oriented to project outwardly as at 63 such that as the lever 30 rotates past a selected position, and accelerated engagement with the cam pin 29 is formed to increase the throttle opening for any given corresponding angular movement of the cam lever 30.

An interrelated drive of the timing lever 31 is established by selective coupling to the throttle lever 30 as follows.

The timing lever 31 is a relatively narrow plate-like link or member with a generally central pivot mounting to the pivot pin 32. The lever 31 extends laterally across the engine with an offset end portion 64 which is pivotally connected to the timing rod for the position of the trigger coil ring. The downwardly offset end 64 is provided with an apertured pivotal pin 65 through which the rod extends. The extended end of the rod 16 is threaded and similar clamp nuts 66 are provided to the opposite sides of the pin 65 to interconnect the rod 16 to the pivot pin 65 and thereby to the outer end of the lever 31.

The opposite end of the lever 31 is provided with a hook end 67 which projects forwardly of the lever 30 generally parallel to the stem 53. A coil spring 68 includes a hook 69 secured to the hook end 67. The coil spring 68 extends laterally across the stem 53 with the opposite end provided with a hook mating with a small upstanding hook wall 71 formed on the upper face of the stem 53. The spring 68 thus urges the timing lever 31 to pivot about the common pivot pin 32 in a counter-clockwise direction, as viewed in FIGS. 2 and 3.

The advance rotational movement of the lever 31 is limited by a stop screw 72 which is threaded through the offset junction portion for the end 62. A stop nut 73 is provided on the threaded screw 72 and engages the front wall of the lever 31 to lock the stop screw in a desired position. The opposite end of the screw 72 projects toward the engine block which is provided with a stop shoulder 74 in alignment with the pivoting path of the stop screw 72. The total rotational movement of the timing lever 31 and therefore coil 21 is determined by the proper positioning of the threaded screw 72. Once the limit is reached, the lever 30 may continue to pivot with the coil spring expanding to accommodate the relative movement.

The lever 31 includes a depending reset pin 75 located in front of lever 30. As the lever 30 is reset, the spring 68 collapses, holding the lever 31 in the advance firing position. The continued reset motion reaches the original limit position at which time the spring 68 is completely collapsed. The lever 30 then positively engages the pin 75 and further reduced throttle closing lever motion produces a reverse or reset pivoting of the lever 30. During the reset pivoting of levers 30 and 31, the cam edge 61 moves across and eventually disengages the throttle control pin means with characteristics previously described.

In summary, the lever 30 is coupled to the throttle cable units 11 and 12 to locate the cross bar of the lever 30 extending across the engine and with the stem 53 projecting outwardly therefrom. The cam member 54 is secured to the stem 53 with the cam edge 61 in rearwardly spaced relation to the throttle pin 29, as shown at 76 in FIG. 3. The coil spring 68 rotates the timing lever 31 until there is no tension in the coil spring 68 and thus holds the timing coil 21 in a predetermined, angular orientation with respect to the crankshaft. Generally, it will be selected to provide a retard firing under idle throttle conditions. To advance the throttle, the twist grip is rotated with the appropriate throttle cable 36 pulling on cam lever 30 which pivots counter-clockwise in FIGS. 2 and 3. The initial movement merely closes the gap 76 between the cam edge 61 and the cam pin 29. Such rotation, however, is transmitted through the spring 68 to the timing lever 31 which is free to rotate during this movement as the result of the outward spacing of the stop screw 72 from the shoulder 74. The gap 76 permits angular orientation of the timing lever 31 to a top dead center position of the piston before the cam edge 61 just engages or touches the throttle pin 29. At this point, the stop screw 72 is still spaced from the shoulder 74 with the timing coil 21 re-established to provide the desired TDC firing. This provides for desired low speed acceleration. As the twist grip 47 is further advanced, resulting in a further pulling on cable 36 and release of cable 36', the lever 30 rotates, picking up the throttle pin 29 and thereby simultaneously providing a throttle advance and a timing advance. The spring 68 transmits the pivot force to the timing lever 31 which continues to rotate until the stop screw 72 engages the shoulder 74. The flat cam surface 62 is such that the throttle advances very slowly while the timing continues to advance rapidly. For example, in a practical construction for a four horsepower outboard engine, the coil 21 is set to produce a 12° retard firing at idle and the gap 76 allows corresponding rotation of coil 21 before picking up pin 29. For a following five degree opening of the throttle, the coil was moved to provide an advanced firing of 25°, at which time the screw 72 engages shoulder 74 and holds the firing at such preselected angle. Thereafter, the extended cam edge 63 rapidly opens the throttle as the result of the angularly orientation thereof. In the practical construction, the total throttle grip movement was approximately 90° and the throttle is advanced from 5° to 70° corresponding to a full throttle position, with the timing fixed at the maximum advance setting.

Opposite rotation of the hand grip 47 results in a corresponding opposite positioning of the linkage. Thus, from the full throttle or the 90° position, the initial return movement merely reduces the tension in the spring 68 with the timing lever 31 held in the maximum advance time position. When the throttle grip has been returned to the 5° throttle position, any further movement results in a corresponding reduced rate of movement of the throttle opening with a relatively rapid resetting of the timing lever 31. The 5° closing of the throttle is accompanied by a 25° movement of the timing to TDC. Thereafter, the final rotation of the grip 47 to the idle position resets the timing lever 31 and of coil 21 to the retard position with the throttle held in the preset idle position by its preset stop.

Applicant has found that the linkage, particularly with the adjustable cam secured to the projection of the T-shaped lever in combination with the common pivot mount of the throttle lever and the timing lever produces a reliable and accurate linkage readily adapted to outboard motor constructions, particularly small outboard horsepower units where the available space is generally highly restricted.

Various modes of carrying out the invention are contemplated as being within the scope of the following claims, particularly pointing out and distinctly claiming the subject matter which is regarded as the invention.

I claim:

1. A throttle control apparatus having a movable throttle setting element, comprising a common pivot pin, a throttle control lever pivotally mounted on the pin and having a minimum throttle position and movable to an advanced throttle position, a timing control lever pivotally mounted on the pin, a drive means coupled to the throttle control lever for pivoting the control lever, resilient means coupling the levers for moving the timing control lever with the throttle control lever, and a lost motion coupling means connected to the throttle control lever and to the throttle setting element for moving the throttle setting element only after a selected initial movement of the throttle control lever and the timing control lever prior to movement of the throttle control lever into engagement with the throttle setting element and wherein said throttle control lever is a T-shaped member having a cross-bar and stem, said lost motion coupling means including an adjustable cam member and releasable attachment means adjustably secured to the stem of said T-shaped member and to the cam member for selective positioning along said stem, and said timing control lever extended generally parallel to the cross-bar, said resilient means coupling the one end of the timing control lever to the stem, the opposite end of the timing control lever including a pivotally mounted timing link.

2. A throttle control linkage for an internal combustion engine including a movable engine throttle element for adjusting the speed setting of the engine and movable between a minimum throttle position and an advanced throttle position and a movable timing control element, comprising a common pivot pin, a pivotally mounted throttle control lever pivotally mounted on said pin and having a projecting portion and having a minimum throttle idle position and rotatable throughout a selected range to an advanced throttle position for progressively increasing of the speed selection of the engine, input positioning means connected to the opposite ends of the throttle control lever for pivoting thereof between said idle and advance positions, a timing control lever pivotally mounted on said pin in stacked relation to the throttle control lever, a throttle control member, an adjustable attachment means connecting said throttle control member to said projecting portion, a second control member connected to the throttle element and located in the path of said first member, said members being disengaged in the idle position of the throttle control lever and producing movement of only the throttle control lever and the first member during the initial movement of the throttle control lever and then engaging said first and second members and thereby connecting of the throttle control lever to the engine throttle control only after such initial movement, said adjustable attachment means being releasably connected to the projecting portion for adjusting of the degree of initial movement and providing selected rotation of the throttle control lever from an idle position prior to engagement of the throttle control element, resilient means connecting the throttle lever to the timing lever for providing a resilient connection therebetween and for forcing the timing lever to follow the opening throttle movement of the throttle control lever, said timing lever having a stop means for limiting the rotation of the timing lever with the throttle lever, said resilient means permitting independent increasing throttle opening motion of the throttle lever.

3. In the throttle control linkage of claim 1 having a one-way coupling means between the throttle lever and the timing lever responsive to opposite rotation of the throttle lever to effect engagement with the timing lever at a predetermined throttle closing position to positively rotate the timing lever to reduce the advance firing position.

4. The control linkage of claim 2 including a throttle operator having a pair of push-pull cable members coupled to the throttle lever to provide opposite motion thereof.

5. The control linkage of claim 2 wherein said throttle control lever is a generally T-shaped throttle lever including a cross-bar pivotally mounted on said pin at the center of the cross-bar and having a stem forming said projecting portion projecting forwardly toward the engine carburetor, said input positioning means being connected to the ends of the cross-bar to thereby provide selective pivoting of the lever on said pin and simultaneously pivoting of the stem, said timing lever being pivotally secured to said common pin in stacked relation to said T-shaped throttle lever and extending generally parallel to said cross-bar.

6. The throttle control linkage of claim 5 wherein said throttle control member has a pair of coupling walls projecting upwardly along the opposite sides of the stem, said one cam wall being slotted, a clamping screw extended through said slot and threading into the stem, said throttle control member having a throttle operating cam surface, the opposite second wall of the throttle control member being movably coupled to the opposite side of the stem to permit adjustment of the member along the length of the stem, said screw member providing for clamping of the cam surface to the stem in predetermined spacing to the throttle control input.

7. The throttle control linkage of claim 6 wherein said cam surface has a generally flat portion spaced from the throttle control input at engine idle and an angularly oriented adjacent portion to sequentially engage the throttle control input in response to predetermined angular orientation of the throttle lever.

8. The throttle control linkage of claim 5 wherein said timing lever includes a hook portion extending laterally parallel to the stem, said resilient means is connected to the hook portion and extends laterally across the stem with the opposite end connected to the top wall of said stem whereby the throttle advance rotation of the throttle lever establishes a corresponding rotation of the timing lever, a timing control link means adjustably secured to the outer end of the lever and coupled to the timing control input, a stop means adjustably secured to the timing lever to limit the pivotal movement of the timing lever and thereby control the total advance position of the timing control.

9. The throttle control linkage of claim 8 wherein said timing lever includes a depending pin portion extending downwardly adjacent the front edge of the throttle lever whereby reverse rotation of the throttle lever effects engagement with the pin at a predetermined angular orientation of the throttle lever to provide a positive returning reset movement of the throttle lever and the timing lever.

10. The apparatus of claim 2 having a common pivot pin secured to the engine block with said levers mounted thereon, said throttle lever is a generally T-shaped throttle lever pivotally mounted on said pin at the center of the cross-bar, means connected to the opposite ends of the cross-bar to thereby provide selective pivoting of the lever, said timing lever being pivotally secured to said common pin in stacked relation to said T-shaped throttle lever and extending generally parallel thereto, said T-shaped throttle lever having a stem portion projecting forwardly toward the engine carburetor, said throttle control member being adjustably secured to the stem for selective spacing from said throttle control input, and wherein said throttle control member is a cam plate releasably secured to said stem with a first surface spaced from the throttle control input at idle and establishing a 12° retard firing of the internal combustion engine with the throttle lever at the engine idle position and establishing rotation of the timing lever to top dead center timing prior to movement of the first surface of the cam into touching engagement with the throttle pin, said cam first surface including a second cam surgace being constructed and formed to open the throttle control input from a preset minimum opening by about 5° open position in synchronism with the movement of the timing lever from top dead center to about 25° before top dead center firing, said throttle stop engaging said shoulder to prevent further movement of the timing lever after said 25° position.

11. The throttle control linkage of claim 2 having a common pivot pin secured to the engine block for said levers, said throttle levers generally being T-shaped with a cross-bar pivotally mounted on said pin at the center of the cross-bar and having an outwardly projecting stem, means connected to the opposite ends of the cross-bar to thereby provide selective pivoting of the lever, said timing lever pivotally secured to said common pin in stacked relation to said T-shaped throttle lever and extending generaly parallel thereto, said T-shaped throttle lever having said stem projecting forwardly toward the throttle input, said lost motion coupling means including a control cam member located beneath said stem and having a pair of coupling walls projecting upwardly along the opposite sides of the stem, said one cam wall being slotted, a clamping screw extended through said slot and threading into the stem, the opposite wall or second wall of the cam member being coupled to the opposite side of the stem by a grooved connection extending parallel to the stem to permit adjustment of the cam member along the length of the stem, said screw member providing for clamping of the cam member to the stem in predetermined spacing to the throttle control input, said cam plate having an outer face shaped to provide predetermined movement of the cam pin in response to predetermined angular orientation of the cam face.

12. The throttle control linkage of claim 11 wherein said timing lever includes a hook portion extending laterally parallel to the stem, said resilient means is a coil spring connected to the hook portion and extending laterally across the stem with the opposite end of the coil spring secured to the top wall of said stem whereby the throttle advance rotation of the throttle lever exerts a resilient pulling force on the timing lever for corresponding rotation of the levers, the opposite end of said timing lever projecting outwardly of the throttle lever, a timing control rod adjustably secured to the outer end of the lever and projecting therefrom into engagement with the timing control input, a stop screw adjustably secured to the second end portion of the timing lever and adjustably extended therethrough, said engine including a stop shoulder aligned with the stop screw to control the limit of pivotal movement of the lever and thereby control the total advance position of the timing control.

13. The throttle control linkage of claim 12 wherein said timing lever includes a depending pin portion extending downwardly adjacent the front edge of the throttle lever whereby reverse rotation of the throttle lever effects engagement with the pin at a predetermined angular orientation of the throttle lever to provide a positive returning reset movement of the throttle lever and the timing lever.

14. The apparatus of claim 12 wherein said cam plate includes a cam surface with a flat surface spaced from the throttle input with the timing lever set to establish a twelve degree retard firing of the internal combustion engine with the throttle lever at the engine idle position, said spacement of the flat surface establishing rotation of the timing lever to top dead center timing with movement of the cam flat surface into touching engagement with the throttle input, said flat surface opening the throttle from 0 to 5° open position in synchronism with the movement of the timing lever from top dead center to 25° advance firing, said throttle stop engaging said shoulder to prevent further movement of the timing lever at the 25° position.

15. A throttle control apparatus for internal combustion engines having a carburetor with a throttle input element and mounted in an outboard motor having a tiller handle with an outer twist grip, comprising a pair of push-pull cable members coupled to the twist grip to provide opposite motion of the cables in response to twisting of the twist grip, a common pivot pin secured to the engine block, a generally T-shaped throttle lever having a cross-bar pivotally mounted on said pin at the center of the cross-bar and having a stem projecting outwardly from the cross-bar, means connecting the opposite ends of the cross-bar to the respective two cables for providing selective pivoting of the lever between an idle position and an advanced throttle position in response to the rotation of the twist grip, a timing lever pivotally secured to said common pin in stacked relation of said T-shaped throttle lever and extending generally parallel thereto, said T-shaped throttle lever having said stem projecting forwardly toward the carburetor, a throttle control cam member located beneath said stem, adjustable coupling means connected to said cam member and said stem for adjusting the location of the cam member on the stem, a cam follower secured to the throttle element, said cam member having an outer cam face shaped with a space between the cam face and cam follower for an initial predetermined movement of the throttle lever and thereafter providing predetermined varying movement of the throttle input element in response with the angular orientation of the cam member relative to said throttle input, and a resilient means coupling the one end of the timing lever to the stem and stop means for limiting the the rotation of the timing lever.

16. The throttle control apparatus of claim 15 wherein said adjustable coupling means includes a pair of coupling walls projecting upwardly along the opposite sides of the stem, said one cam wall being slotted parallel to the stem extension, a clamping screw extended through said slot and threading into the stem, the second coupling wall of the cam member being coupled to the opposite side of the stem by an interlocking, grooved connecting extending parallel to the stem to permit said adjustment of the cam member along the length of the stem, and said clamping screw member providing for clamping of the cam member to the stem in predetermined spacing to the throttle control pin.

17. The throttle control apparatus of claim 16 wherein said timing lever includes a hook portion extending laterally parallel to the stem, said resilient means is a coil spring connected to the hook portion and extending laterally across the stem with the opposite end of the coil spring connected to the top wall of said stem whereby the throttle advance rotation of the throttle lever exerts a pulling force on the timing lever, the opposite end of said lever projecting outwardly of the throttle lever, a timing control rod adjustably secured to the outer end of the lever and projecting therefrom into engagement with the timing control element, a stop screw adjustably secured to the second end portion of the timing lever and adjustably extended therethrough, said engine including a stop shoulder aligned with the stop screw to control the limit of pivotal movement of the lever and thereby control the total advance position of the timing control.

18. The throttle control apparatus of claim 17 wherein said timing lever having a depending pin portion extending downwardly adjacent the edge of the throttle lever whereby reverse rotation of the throttle lever effects engagement with the pin at a predetermined angular orientation of the throttle lever to provide a positive returning and reset movement of the throttle lever and the timing lever.

19. The apparatus of claim 17 wherein said cam plate is secured to said stem in spaced relation to the throttle control pin and said timing lever to establish about a 12° retard firing of the internal combustion engine with the throttle lever at the engine idle position, and said throttle lever's initial rotation establishes rotation of the timing lever to top dead center timing in synchronism with movement of the cam fact into touching engagement with the throttle pin, said cam face being constructed and formed to open the throttle from 0 to 5° in synchronism with the movement of the timing lever from top dead center to 25° before top dead center firing, said throttle stop engaging said shoulder to prevent further movement of the timing lever at said 25° position, and said throttle lever providing for subsequent full opening of said throttle.

* * * * *

UNITED STATES PATENT AND TRADEMARK OFFICE

CERTIFICATE OF CORRECTION

PATENT NO. : 4,071,002

DATED : January 31, 1978

INVENTOR(S) : JAMES H. FRAHM

It is certified that error appears in the above-identified patent and that said Letters Patent are hereby corrected as shown below:

| | | | | |
|---|---|---|---|---|
| ABSTRACT Column | 2, | Line | 14, | after "guide" cancel "wal" and insert ---wall---; |
| Column | 3, | Line | 10, | after "long-life" cancel "throtthe" and insert --- throttle ---; |
| Column | 4, | Line | 9, | after "engine 6" insert --- in timed relation ---; |
| Column CLAIM 10 | 10, | Line | 37, | after "cam" cancel "surgace" and insert --- surface ---; |
| Column CLAIM 11 | 10, | Line | 54, | after "extending" cancel "generaly" and insert --- generally ---; |
| Column CLAIM 15 | 12, | Line | 9, | before "rotation" cancel "the" (first occurrence); |

UNITED STATES PATENT AND TRADEMARK OFFICE

CERTIFICATE OF CORRECTION

PATENT NO. : 4,071,002 PAGE 2 OF 2

DATED : January 31, 1978

INVENTOR(S) : JAMES H. FRAHM

It is certified that error appears in the above-identified patent and that said Letters Patent are hereby corrected as shown below:

Column 12, Line 58, after "cam" cancel "fact" and insert --- face ---.
CLAIM 19

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*